US006685268B2

(12) United States Patent
Meyer

(10) Patent No.: US 6,685,268 B2
(45) Date of Patent: Feb. 3, 2004

(54) SEAT ARRANGEMENT FOR SITTING FURNITURE

(76) Inventor: Stephan Meyer, Hans-Sachs-Gasse 9, Freiburg (DE), D-79088

( * ) Notice: Subject to any disclaimer, the term of this patent is extended or adjusted under 35 U.S.C. 154(b) by 0 days.

(21) Appl. No.: 10/007,597

(22) Filed: Nov. 13, 2001

(65) Prior Publication Data

US 2002/0060486 A1 May 23, 2002

(30) Foreign Application Priority Data

Nov. 17, 2000 (DE) ..... 200 19 569 U

(51) Int. Cl.[7] ..... A47C 1/04
(52) U.S. Cl. ..... 297/313; 297/314
(58) Field of Search ..... 297/313, 314

(56) References Cited

U.S. PATENT DOCUMENTS

| | | | | | |
|---|---|---|---|---|---|
| 614,596 | A | * | 11/1898 | Wilson | 297/314 |
| 680,158 | A | * | 8/1901 | Light | 297/314 |
| 2,132,291 | A | * | 10/1938 | Fitos | 297/314 |
| 2,787,315 | A | * | 4/1957 | Siebert | 297/313 |
| 3,869,171 | A | * | 3/1975 | Wilson | 297/313 |
| 4,372,606 | A | * | 2/1983 | Faull | 297/313 |
| 4,830,345 | A | * | 5/1989 | Mar | 297/314 X |
| 4,890,886 | A | * | 1/1990 | Opsvik | 297/313 |
| 5,288,127 | A | * | 2/1994 | Berg et al. | 297/313 X |
| 5,769,492 | A | * | 6/1998 | Jensen | 297/314 |
| 5,913,568 | A | * | 6/1999 | Brightbill et al. | 297/314 X |
| 6,019,422 | A | * | 2/2000 | Taormino et al. | 297/313 X |
| 6,481,795 | B1 | * | 11/2002 | Pettibon | 297/314 |
| 2002/0043846 | A1 | * | 4/2002 | Brauning | 297/314 |

FOREIGN PATENT DOCUMENTS

| | | | | |
|---|---|---|---|---|
| DE | 43 01 734 A1 | * | 7/1993 | 297/313 |

* cited by examiner

*Primary Examiner*—Rodney B. White
(74) *Attorney, Agent, or Firm*—Gudrun E. Huckett

(57) ABSTRACT

A seat arrangement for sitting furniture such as chairs has a seat member and a support arranged underneath the seat member, wherein the support has an elastic body allowing a tilting movement of the seat member about a pivot point arranged at the central seat member area. The elastic body is arranged at the center of the seat member and has an upper side and an underside. The support has a rigid top plate fixedly connected to the upper side of the elastic body and a rigid bottom plate fixedly connected to the underside of the elastic body. The top plate is correlated with the seat member and the bottom plate is correlated with an underframe of the sitting furniture. The same type of tilting support can also be arranged on a back rest of a chair.

18 Claims, 4 Drawing Sheets

SEAT ARRANGEMENT FOR SITTING FURNITURE

BACKGROUND OF THE INVENTION

1. Field of the Invention

The invention relates to a seat arrangement for sitting furniture. The seat arrangement comprises a seat member and a support arranged at the underside of the seat member and comprising an elastic body for enabling a tilting movement of the seat member about a pivot point located in a central area of the seat member.

2. Description of the Related Art

Seat arrangements which make possible a tilting movement of the seat member about a pivot point centrally arranged on the seat member area are known in various embodiments. The basic principle always resides in that a tilting support is arranged at the underside of the seat member and comprises an elastic body. This elastic body counteracts the tilting movement with a matching restoring force.

A disadvantage of these known tilting devices is the generally relatively complex configuration.

SUMMARY OF THE INVENTION

It is an object of the present invention to provide a technically simple seating arrangement for sitting furniture.

In accordance with the present invention, this is achieved in that the elastic body is arranged at the central middle of the seat member, in that the upper side as well as at the underside of the elastic body are fixedly connected to a rigid plate, respectively, and that the top plate is correlated with the seat member and the bottom plate is correlated with the underframe of the sitting furniture.

The basic configuration of the seat arrangement according to the present invention for a piece of sitting furniture comprises a central elastic body which is embedded in a sandwich arrangement between two rigid plates, wherein these two plates are fixedly connected with the elastic body. The elastic body can be particularly made of rubber but also of an elastic plastic material. This provides a technically very simple seat articulation wherein the seat member surface (sitting surface) can be tilted to all sides; this makes possible a dynamic and back-strengthening sitting position. The seat articulation can be mounted in a simple way on different sitting furniture, particularly, chairs (office chairs, stools etc.) without the configuration or the design of these chairs having to be changed. Moreover, the tilting articulation according to the invention is a very inexpensive alternative for movable chairs.

According to a first particular embodiment of the invention, the elastic body is a hollow body. The mantle surface of the hollow body is thus compressed upon tilting of the seat member in the corresponding direction.

According to a further development of this embodiment, the hollow body is a cylindrical body or a barrel body. A characteristic of this hollow body is that it has an outer mantle surface and has a penetration or hollow interior. A barrel body is to be understood as a body whose peripheral mantle surface is either bulged convexly outwardly or constricted concavely inwardly.

According to another development of this embodiment, the cross-section of the cylindrical body or of the barrel body can be a circle or an oval. Inasmuch as the cross-section is a circle, the tilting movement is identical in any radial direction because the same force is always required. For an oval cross-section, on the other hand, the tilting movement is not uniform because, depending on the direction, different forces are required for compressing the hollow body. Accordingly, the tilting characteristic can be affected with regard to the tilting direction. This directional tilting characteristic can be achieved also for a circular hollow body in that the material distribution of the mantle is different about the periphery, for example, in that the mantle has a reduced thickness at certain locations or in that the mantle is provided with hollow spaces at certain locations. Of course, an oval hollow body can also have such different material distributions about its periphery.

According to a further development of the embodiment, the mantle surface of the cylindrical body or of the barrel body is of a contiguous configuration. This means that the entire mantle surface of the body is closed about the periphery.

As an alternative, the hollow body can be comprised of individual elements or mantle sections arranged at several locations on an imaginary ring or annular contour which have between then an intermediate spacing. The number of the individual elements can be selected as desired. However, at least three such elements should be provided.

In a further development of the embodiment, the top and bottom plates have cutouts matching the penetration or hollow interior of the hollow body. This has the advantage that the attachment of the hollow body or annular body on the two plates is simplified in that, for example, vulcanization tools can engage the central opening of the hollow body. Moreover, as a result of the penetrations access to the underside of the seat member as well as to the upper side of the under frame is possible.

As an alternative to the hollow body, the invention proposes a second embodiment according to which the elastic body is a solid body, i.e., not hollow.

According to one development of this embodiment, the solid body is a cylindrical body or a barrel body wherein, according to a specific configuration, the cross-section of these bodies is a circle or an oval, respectively. The solid configuration of the elastic body requires a relatively high force for compression of the body upon tilting. In this connection, a barrel body is to be understood again as one that has a peripheral mantle surface which is either bulged convexly outwardly or constricted concavely inwardly. The inwardly directed curvature enhances the longevity of the solid body. An oval cross-section ensures again a directional compression characteristic.

Preferred technical possibilities for the attachment of the elastic body on the two plates are a vulcanized connection, an adhesive connection, or screw connection. Preferred is the use of vulcanization technology because it provides an absolutely secure and non-detachable connection between rubber and metal without there being the risk that over the course of time the parts will become detached. Alternatively, the materials can also be glued or bonded to one another. In particular in the case of solid bodies a screw connection between the elastic body and the plates is also conceivable.

In connection with vulcanization it is sufficient to realize vulcanization in the area of the outer circumference of the elastic body. This is particularly feasible when the elastic body is an annular body and can be connected with the circumferential edge of its end face to the corresponding penetration of the plate by vulcanization.

According to a modification of the invention, the seat articulation is provided as a separate unit comprised of the elastic body and the two plates, wherein the top plate is connected to the seat member and the bottom plate is connected to the underframe of the sifting furniture.

In contrast to this, it is suggested according to another modification that no separate top and bottom plates are provided but that the elastic body is directly connected to the seat member and/or directly connected to the underframe of the sifting furniture. This provides a seat articulation with even fewer individual parts.

While the seat articulation or seat arrangement according to the invention can be integrated into conventional sitting furniture, a further embodiment suggests that the seat arrangement is a separate unit. This provides an ergonomic seat cover which is not integrated from the start in the sitting furniture but instead is to be installed later in that the seat arrangement is simply placed like a seat cushion onto the seat surface of the seat. The advantage of this separate seat arrangement is that in a technically simple way retrofitting of existing sitting furniture, initially not provided with a tilting device, is possible. The seat of the conventional sitting furniture which is accordingly retrofitted with the seat arrangement according to the invention thus enables an ergonomic sitting position.

When using the tilting seat arrangement according to the invention, a constant balancing is required and each fine movement must be compensated in the same way as when seated on a large ball; this improves posture and strengthens the back muscles, wherein moreover their interaction is optimized and, as a whole, back pain is eliminated.

The advantage of a modification comprising a protective sleeve between the plates resides in that the user is prevented from pinching his fingers between the two plates when the tilting movement is carried out.

The tilting articulation has been described supra in connection with a seat member of sitting furniture. However, it is also conceivable to provide the tilting articulation of the seat arrangement as a connection between a frame element and a back rest of a seat member. The tilting articulation is configured in analogy to the described seat articulation of the seat member. Basically, the principle of the invention thus resides generally in providing a tilting articulation for sitting furniture and seat arrangements, in particular, for the seat member and/or the back rest.

DESCRIPTION OF THE PREFERRED EMBODIMENTS

Figure 1:
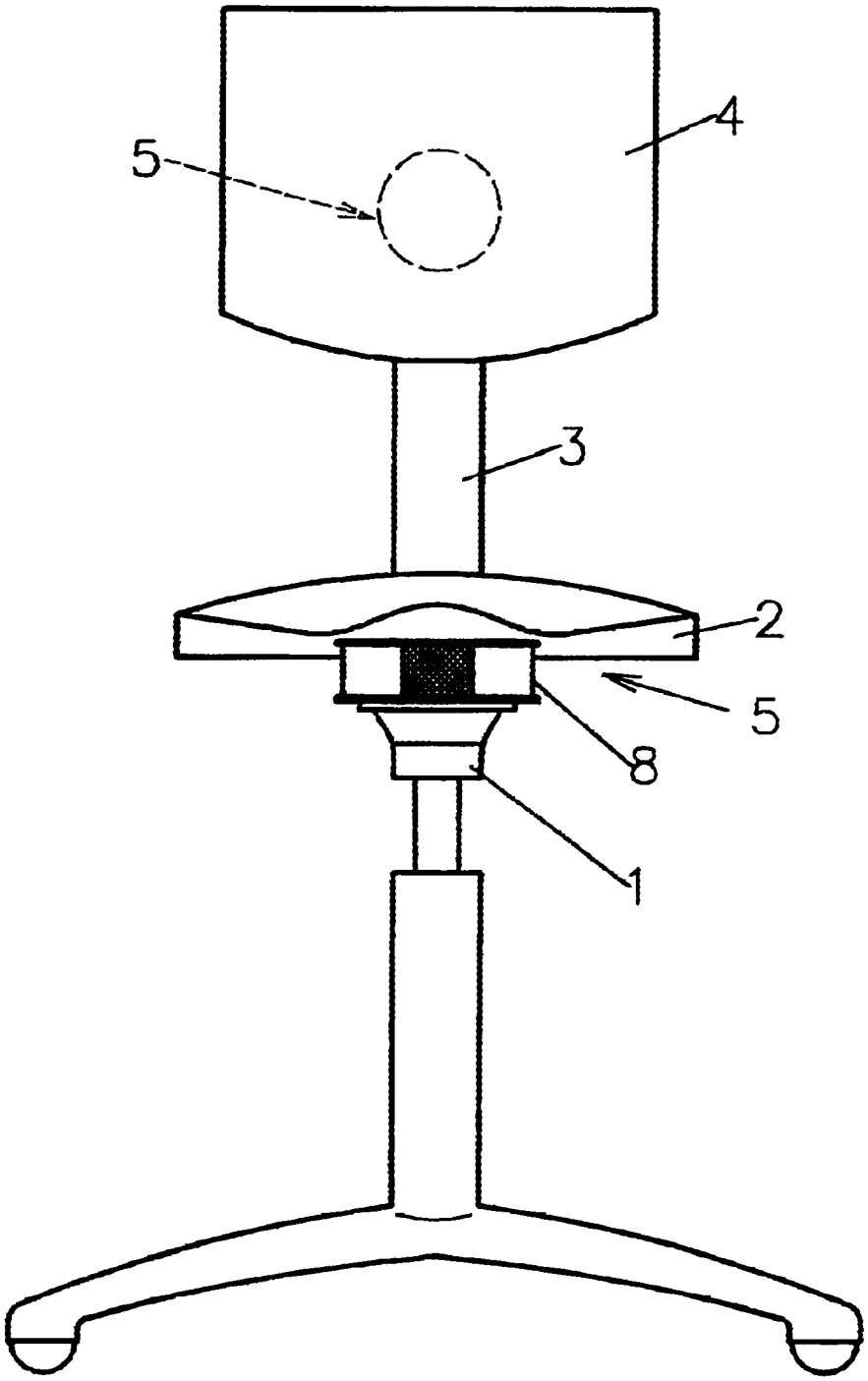
FIG. 1 is a frontal view of a chair.

The piece of sitting furniture in the form of a chair illustrated in FIG. 1 has an underframe 1, a seat member 2 as well as a vertical frame element 3 provided with a back rest 4.

Figure 2:
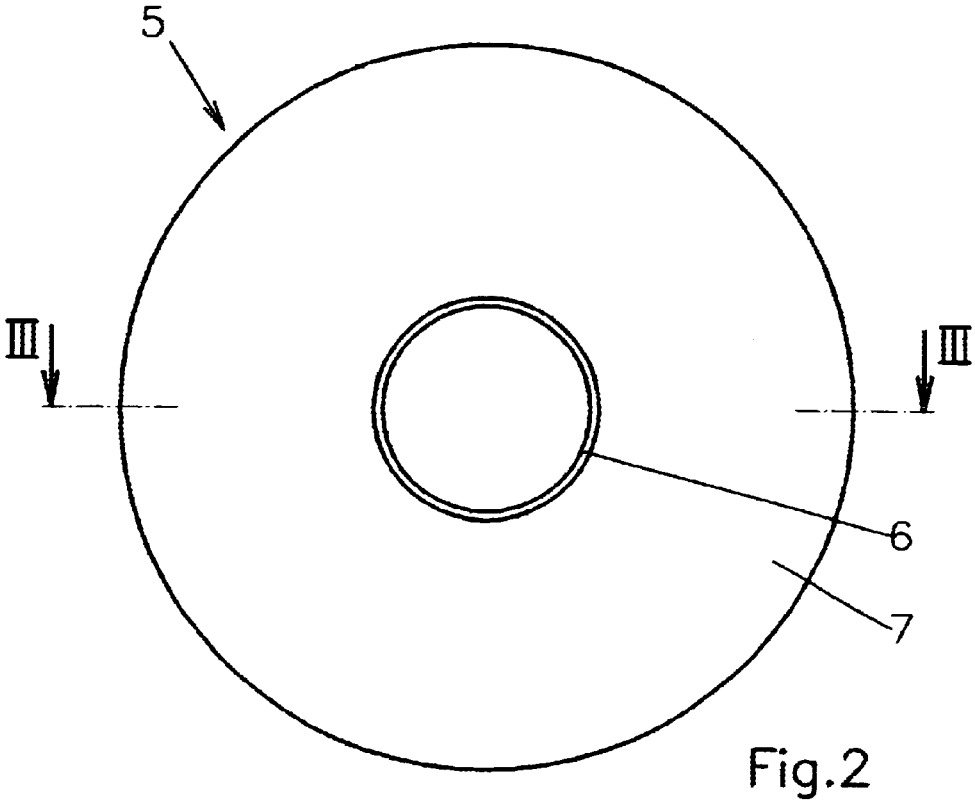
FIG. 2 is a plan view onto a seat articulation according to the invention with a circular cross-section of the elastic body.
Figure 3:
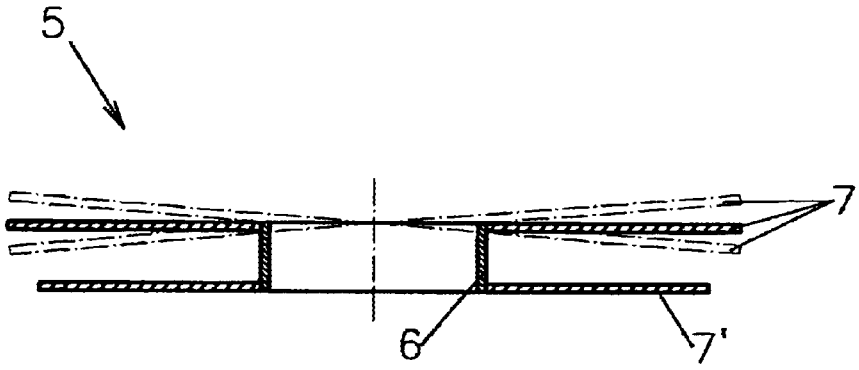
FIG. 3 is a section along the line III—III in FIG. 2 of the seat articulation.

Between the underframe 1 and the seat member 2 a tilting support 5 is arranged which is illustrated in detail in FIGS. 2 and 3. It is comprised of an elastic body 6 in the form of a cylindrical annular body of rubber. On the upper side side as well as on the underside a plate 7, 7' is provided, respectively, onto which the elastic body 6 is vulcanized so that in this way a fixed, non-detachable connection is provided. In this connection, the plates 7, 7' have cutouts matching the center penetration or hollow interior of the annular body. In the illustrated embodiment the plates 7, 7' are round, with the top plate 7 being larger than the bottom plate 7'.

The support 5 is fastened by means of its top plate 7 on the underside of the seat member 2; the bottom plate 7' is fastened on the underframe 1.

The function of the seat articulation is as follows:

In the rest position, the top plate 7 and thus the seat member 2 are horizontally aligned. When a person sitting on the seat member 2 laterally loads the seat member 2, the seat member 2 can be tilted to all sides; this makes possible a dynamic back-strengthening sitting action. The tilting positions are illustrated in dashed lines in FIG. 3. In FIG. 1 a protective sleeve 8 is provided between the two plates 7, 7' which prevents the user from pinching his fingers when using the sitting furniture provided with the inventive seat arrangement.

The tilting articulation is not only designed for use between the underframe 1 and the seat member 2 but also between the frame element 3 and the back rest 4. The tilting element is indicated in FIG. 1 only as a dashed circle within the back rest 4. The basic principle of this tilting element provided between the frame element 3 and the back rest 4 however does not differ from the one of the seat articulation. Accordingly, reference is being have to the explanations of the configuration and function of the seat articulation provided supra.

Figure 4:
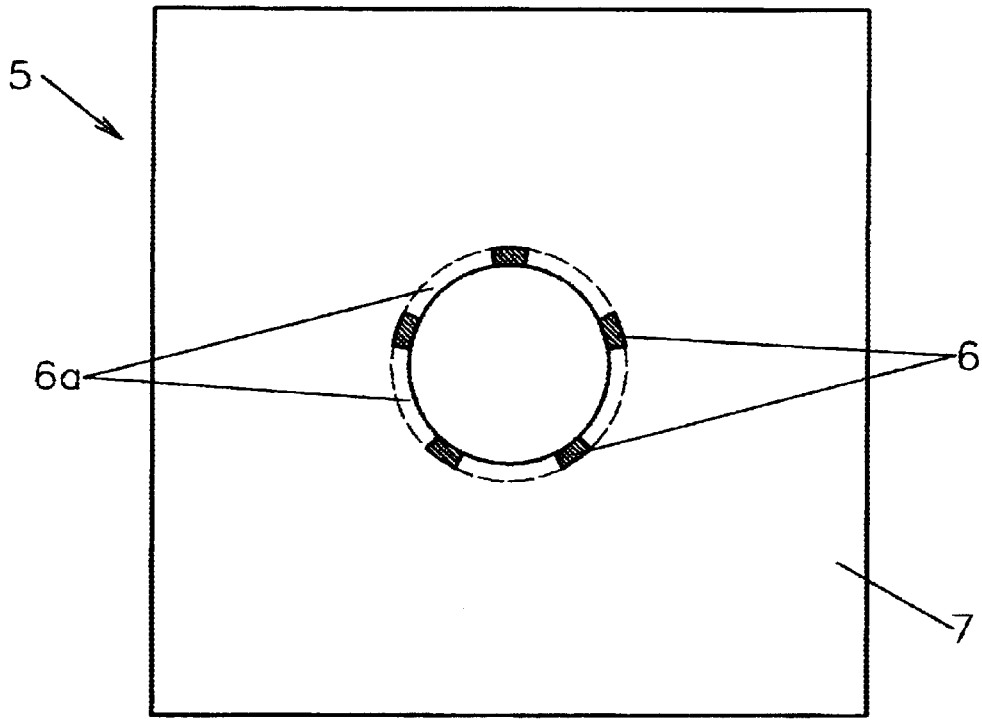
FIG. 4 is a plan view onto a modification of the seat articulation according to FIG. 2.
Figure 5:
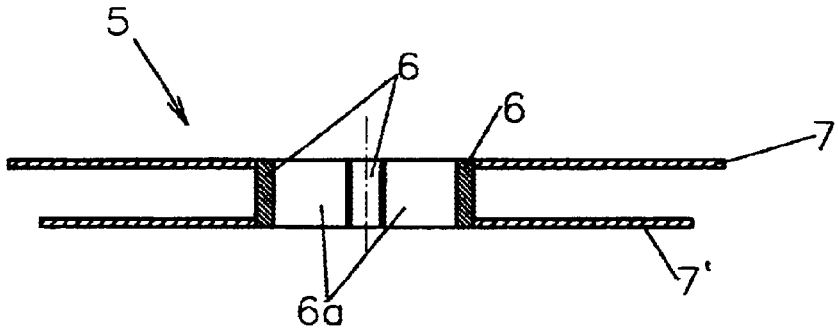
FIG. 5 is a section of the seat articulation of FIG. 4.

FIGS. 4 and 5 show a modified embodiment of the elastic body 6. The elastic body is not provided as a contiguous mantle surface but is configured of a total of five individual elements which are arranged on an imaginary cylinder mantle surface or contour so that intermediate spaces 6*a* are present between these individual elements 6. In this illustrated embodiment the plates 7, 7' are square, with the top plate 7 being larger than the bottom plate 7'.

Figure 6:
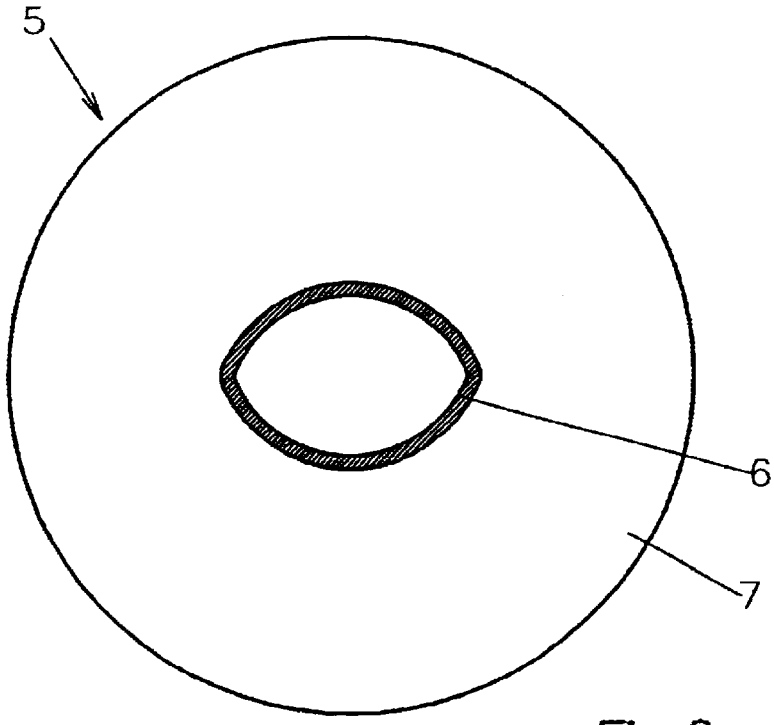
FIG. 6 is a plan view onto a seat articulation according to the invention with an oval cross-section of the elastic body.

The embodiment according to FIG. 6 shows a contiguous elastic body 6 with an oval cross-section. Accordingly, the tilting movement is not uniform, and the compression force is directional.

Figure 7:
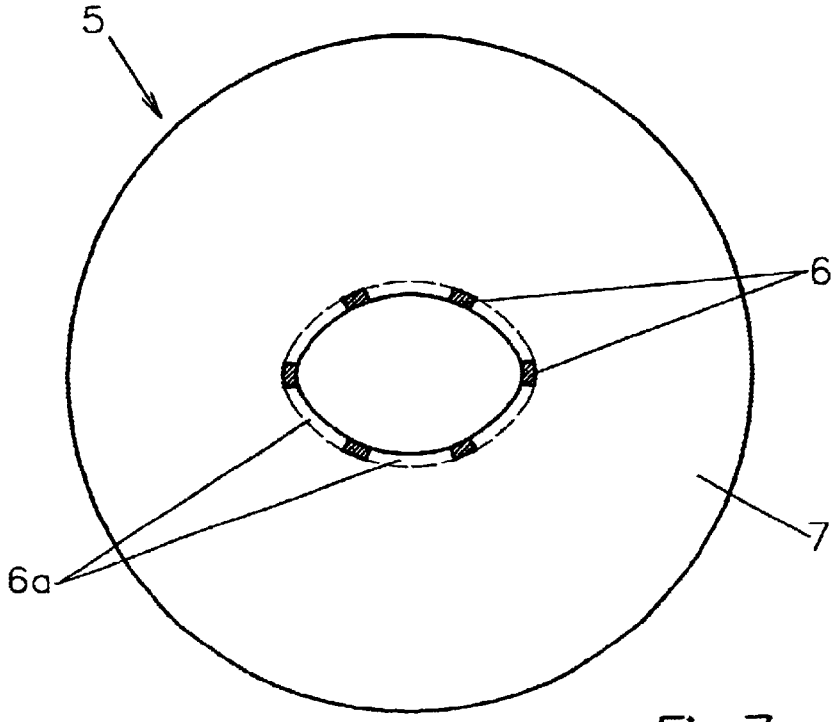
FIG. 7 shows a plan view of a modification of the seat articulation of FIG. 6.

The embodiment of FIG. 7 finally shows again an oval cross-section. However, in this embodiment, as in the embodiment of FIGS. 4 and 5, individual elements 6*a*, that are spaced apart (spaces 6*a*), are arranged on an imaginary mantle contour.

Between the frame element 3 and the back rest 4, as indicated in FIG. 1, an elastic body 6 is arranged as a tilting element; it can have any of the configurations described above in connection with the seat articulation.

While specific embodiments of the invention have been shown and described in detail to illustrate the inventive principles, it will be understood that the invention may be embodied otherwise without departing from such principles.

What is claimed is:

1. A seat arrangement for sitting furniture, comprising a seat member (2) and a support (5) arranged underneath the seat member (2), wherein the support (5) is comprised of an elastic body (6) and a rigid top plate (7) and a rigid bottom plate (7'), wherein the elastic body (6) is arranged between the top plate (7) and the bottom plate (7') in a sandwich arrangement and is configured to allow a tilting movement of the seat member (2) about a pivot point arranged at a central area of the seat member, wherein the elastic body (6) is arranged centrally on the seat member (2) and is comprised of rubber or an elastic plastic material, wherein the elastic body (6) has an upper side and an underside, wherein the rigid top plate (7) is fixedly and non-detachably connected to the upper side of the elastic body (6) and the rigid bottom plate (7') is fixedly and non-detachably connected to the underside of the elastic body (6), and wherein the top plate (7) is adapted to be connected to the seat member (2) and the bottom plate (7') is adapted to be connected to an underframe of the sitting furniture, wherein the top plate (7) and the bottom plate (7') are connected to the elastic body (6) by a vulcanized connection, by an adhesive connection, or by a screw connection.

2. The seat arrangement according to claim 1, wherein the elastic body (6) is a hollow body.

3. The seat arrangement according to claim 2, wherein the hollow body is a cylindrical body or a barrel body.

4. The seat arrangement according to claim 3, wherein the hollow body has a circular cross-section or an oval cross-section.

5. The seat arrangement according to claim 3, wherein the hollow body has a contiguous peripheral mantle surface.

6. The seat arrangement according to claim 3, wherein the cylindrical body or the barrel body is comprised of individual elements extending in an axial direction of the hollow body, wherein the individual elements are arranged on an imaginary mantle contour of the cylinder body or the barrel body, wherein the individual elements are spaced from one another in a circumferential direction of the imaginary mantle contour.

7. The seat arrangement according to claim 2, wherein the top plate (7) and the bottom plate (7') have a central cutout matching a hollow interior of the hollow body.

8. The seat arrangement according to claim 1, wherein the elastic body (6) is a solid body.

9. The seat arrangement according to claim 8, wherein the solid body is a cylindrical body or a barrel body.

10. The seat arrangement according to claim 9, wherein the hollow bed has a circular cross-section or an oval cross-section.

11. The seat arrangement according to claim 1, wherein the vulcanized connection is located in an area of an outer circumference of the elastic body (6).

12. The seat arrangement according to claim 1, wherein the top plate (7) is connected to the seat member (2).

13. The seat arrangement according to claim 1, wherein the top plate (7) is formed by the seat member (2).

14. The seat arrangement according to claim 1, wherein the bottom plate (7') is configured to be connected to the underframe of the sifting furniture.

15. The seat arrangement according to claim 1, wherein the bottom plate (7') is formed by the underframe of the sitting furniture.

16. The seat arrangement according to claim 1, comprising a protective sleeve (8) positioned between the top plate (7) and the bottom plate (7') and arranged about a periphery of the top and bottom plates (7, 7').

17. A seat arrangement for sitting furniture, comprising a seat member (2) and a frame element (3) with a back rest (4) connected to the seat member (20), comprising a support (5) arranged between the frame element (3) and the back rest (4), wherein the support (5) is comprised of an elastic body (6) and a rigid top plate (7) and a rigid bottom plate (7'), wherein the elastic body (6) is arranged between the top plate (7) and the bottom plate (7') in a sandwich arrangement and is configured to allow a tilting movement of the back rest (4) relative to the frame element (3) about a pivot point arranged at a central area of the back rest (4), wherein the elastic body (6) is arranged centrally on the back rest (4) and is comprised of rubber or an elastic plastic material, wherein the elastic body (6) has an upper side and an underside, wherein the rigid top plate (7) is fixedly and non-detachably connected to the upper side of the elastic body (6) and the rigid bottom plate (7') is fixedly end non-detachably connected to the underside of the elastic body (6), and wherein the top plate (7) is adapted to be connected to the frame element (3) and the bottom plate (7') adapted to be connected to the back rest (4), wherein the top plate (7) and the bottom plate (7') are connected to the elastic body (6) by a vulcanized connection, by an adhesive connection, or by a screw connection.

18. A seat arrangement for sitting furniture, comprising a seat member (2) and a support (5) arranged underneath the seat member (2), wherein the support (5) is comprised of an elastic body (6) and a rigid top plate (7) and a rigid bottom plate (7'), wherein the elastic body (6) is arranged between the top plate (7) and the bottom plate (7') in a sandwich arrangement and is configured to allow a tilting movement of the seat member (2) about a pivot point arranged at a central area of the seat member, wherein the elastic body (6) is arranged centrally on the seat member (2) and is comprised of rubber or an elastic plastic material, wherein the elastic body (6) has an upper side and an underside, wherein the rigid top plate (7) is fixedly connected to the upper side of the elastic body (6) and the rigid bottom plate (7') is fixedly connected to the underside of the elastic body (6), wherein the top plate (7) is adapted to be connected to the seat member (2) and the bottom plate (7') is adapted to be placed onto a seat of the sitting furniture, and wherein the top pate (7) and the bottom plate (7') are connected to the elastic body (6) by a vulcanized connection, by an adhesive connection, or by a screw connection.

* * * * *